US010281242B2

(12) United States Patent
Knies et al.

(10) Patent No.: US 10,281,242 B2
(45) Date of Patent: May 7, 2019

(54) MATERIAL AND PROCESS FOR COUPLING IMPULSES AND SHOCKWAVES INTO SOLIDS

(71) Applicants: David L. Knies, Marbury, MD (US); Kenneth S. Grabowski, Alexandria, VA (US); Alex E. Moser, Fort Washington, MD (US)

(72) Inventors: David L. Knies, Marbury, MD (US); Kenneth S. Grabowski, Alexandria, VA (US); Alex E. Moser, Fort Washington, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 337 days.

(21) Appl. No.: 13/920,807

(22) Filed: Jun. 18, 2013

(65) Prior Publication Data

US 2013/0340604 A1 Dec. 26, 2013

Related U.S. Application Data

(60) Provisional application No. 61/662,006, filed on Jun. 20, 2012.

(51) Int. Cl.

| | |
|---|---|
| ***F41H 5/04*** | (2006.01) |
| ***F41H 5/013*** | (2006.01) |
| ***F42D 5/045*** | (2006.01) |

(52) U.S. Cl.

CPC ..... *F41H 5/04* (2013.01); *F41H 5/013* (2013.01); *F42D 5/045* (2013.01)

(58) Field of Classification Search

CPC ..... F41H 5/013; F41H 5/04; F42D 5/045
USPC ..... 42/36.01–36.17; 89/36.01–36.17
See application file for complete search history.

(56) References Cited

U.S. PATENT DOCUMENTS

| | | | | |
|---|---|---|---|---|
| 4,179,979 | A * | 12/1979 | Cook et al. | 89/36.02 |
| 4,704,943 | A * | 11/1987 | McDougal | 89/36.02 |
| 4,757,742 | A * | 7/1988 | Mazelsky | 89/36.02 |
| 7,685,922 | B1 * | 3/2010 | Martin | F41H 5/0414 89/36.01 |
| 7,866,248 | B2 * | 1/2011 | Moore et al. | 89/36.02 |
| 8,646,373 | B1 * | 2/2014 | Kucherov et al. | 89/36.11 |
| 2002/0058450 | A1 * | 5/2002 | Yeshurun et al. | 442/59 |
| 2002/0092415 | A1 * | 7/2002 | Caron | 89/36.02 |
| 2006/0013977 | A1 * | 1/2006 | Duke | F41H 5/04 428/36.9 |
| 2006/0201318 | A1 * | 9/2006 | LaBrash et al. | 89/36.02 |
| 2008/0105114 | A1 * | 5/2008 | Gabrys | 89/36.02 |
| 2010/0212484 | A1 * | 8/2010 | Williams et al. | 89/36.02 |
| 2011/0067561 | A1 * | 3/2011 | Joynt | 89/36.02 |
| 2014/0099472 | A1 * | 4/2014 | Greenhill et al. | 428/147 |

* cited by examiner

*Primary Examiner* — Stephen Johnson
*Assistant Examiner* — Benjamin S Gomberg
(74) *Attorney, Agent, or Firm* — US Naval Research Laboratory; Roy Roberts

(57) ABSTRACT

An armor system includes an armor plate, and an appliqué affixed to an exterior of the armor plate, wherein the appliqué has a density increasing in a direction towards the armor plate and configured to minimize reflection of a blast wave from the armor plate. Also disclosed are method of making such an armor system.

11 Claims, 15 Drawing Sheets

MATERIAL AND PROCESS FOR COUPLING IMPULSES AND SHOCKWAVES INTO SOLIDS

CROSS-REFERENCE TO RELATED APPLICATIONS

This Application claims the benefit of U.S. Provisional Application 61/662,006 filed on Jun. 20, 2012, is incorporated herein by reference in its entirety.

BACKGROUND

In order to reduce harm to persons and property, it is desirable to mitigate high intensity impulses such as from blasts and projectiles. These impulses can arise from IEDs (Improvised Explosive Devices), mines, and the like.

BRIEF SUMMARY

In one embodiment, an armor system includes an armor plate, and an appliqué affixed to an exterior of the armor plate, wherein the appliqué has a density increasing in a direction towards the armor plate and configured to minimize reflection of a blast wave from the armor plate.

In another embodiment, a method of forming an armor system includes affixing an appliqué to an exterior of an armor plate, wherein the appliqué has a density increasing in a direction towards the armor plate and configured to minimize reflection of a blast wave from the armor plate.

BRIEF DESCRIPTION OF THE DRAWINGS

FIG. 4, bottom, shows a view from over structured plate. The asperities on the plate need not be pyramidal and could be conical, tetrahedral, other geometries or a combination of geometries and heights or aspect ratios

DETAILED DESCRIPTION

Definitions

Before describing the present invention in detail, it is to be understood that the terminology used in the specification is for the purpose of describing particular embodiments, and is not necessarily intended to be limiting. Although many methods, structures and materials similar, modified, or equivalent to those described herein can be used in the practice of the present invention without undue experimentation, the preferred methods, structures and materials are described herein. In describing and claiming the present invention, the following terminology will be used in accordance with the definitions set out below.

As used in this specification and the appended claims, the singular forms "a", "an," and "the" do not preclude plural referents, unless the content clearly dictates otherwise.

As used herein, the term "and/or" includes any and all combinations of one or more of the associated listed items.

As used herein, the term "about" when used in conjunction with a stated numerical value or range denotes somewhat more or somewhat less than the stated value or range, to within a range of ±10% of that stated.

Description

For blast mitigation, it can be shown from first principle momentum and energy conservation considerations that the minimum momentum and kinetic energy transfer occurs for a maximum inelastic collision. To accomplish this requires a structure that both maximizes energy dissipation and provides ideal coupling. Described here are appliqués to better match the impedance of the shock wave and blast products while allowing for energy dissipation. In one embodiment, the two functions (dissipation and coupling) are provided into two separate appliqués, however, it is possible to integrate the two functions into a single appliqué.

Materials Considerations for Energy Dissipation

Figure 1:
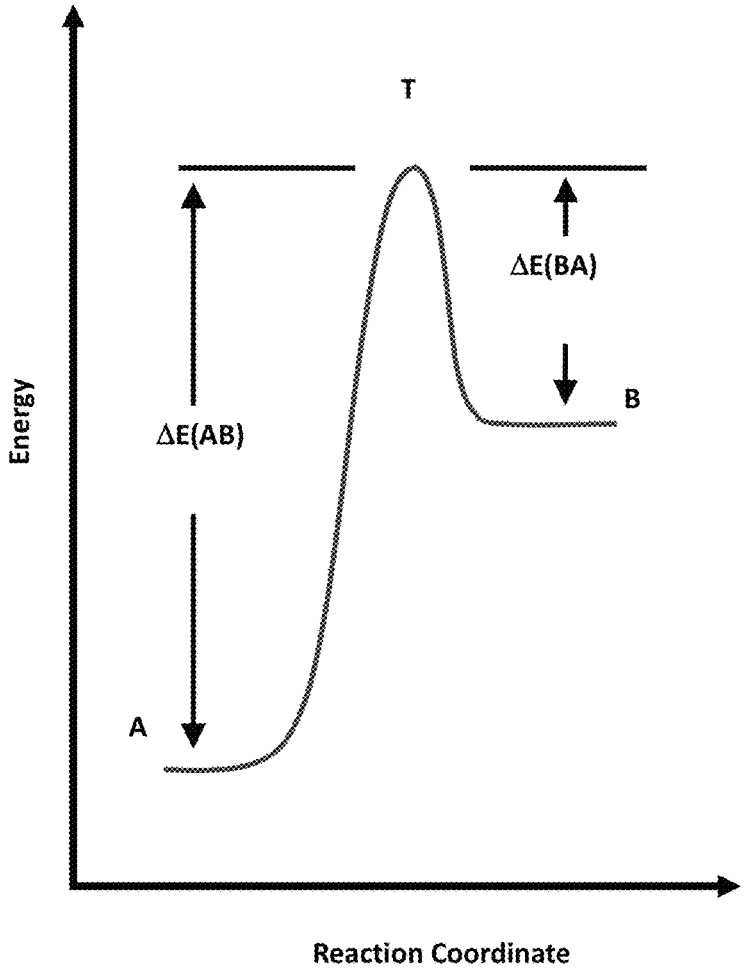
FIG. 1 illustrates the transition energy involved when a brittle material is used to mitigate a shock wave. In the case of glass, it shows the path the reaction takes from bulk glass (A) to powdered glass (B).

One example of impulse mitigation involves a brittle material, such as glass, fracturing, adsorbing energy from the impulse, and preventing the impulse energy from harming personnel and equipment (see U.S. Pat. No. 8,176,831 and U.S. Patent Publication Nos. 2011/0203452 and 2012/0234164, each of which is incorporated herein by reference). In order for the brittle glass material within the armor system to be an effective energy absorber, it must transition through a high energy excited state associated with an activation barrier between the glass initial state and a final powdered state, as noted in Kucherov, et. al. (reference 1 below). The difference in energy between the initial and transition state, $\Delta E$, dictates the rate, through an Arrhenius-like relationship, of the transformation from bulk to powdered glass, seen in FIG. 1.

Further, if the energy of the blast is not great enough, the transformation may not proceed and no significant energy will be absorbed by the glass. Yet, the unabsorbed energy may still be greatly detrimental to personnel behind the glass armor layer. Polymeric materials and composites have demonstrated an ability to absorb blast energy and a potential for coupling blast waves. Further, the activation barrier energy, $\Delta E$, is lower than that found in the glass powdering process. Thus, even at lower blast energies, polymeric materials have the potential to absorb a significant portion of the blast. Also, since a plastic's $\Delta E$ is lower than that of glass, the transformation rate will be greater and the total number of finite components in the bulk polymeric material undergoing transformation will be much greater than that of glass. Thus, powdering and/or plastic deformation of polymeric materials has been demonstrated to be as, or more effective, than glass. Polymeric materials, since they are typically not as brittle as glass, are more durable and fieldable, as well. Specifically, polyvinylchloride (PVC) has been demonstrated to be a good energy absorbing material, likely due to its ability to form extended regions of irreversible plastic deformation upon exposure to a blast. Results of PVC as an energy absorbing layer during blast tests is given in Table 2 below. This specific type of PVC (Type I) may not be the optimal type for blast protection. There exist several hundred PVC formulations available on the market, so that another may prove to be better suited to this application.

Figure 2:
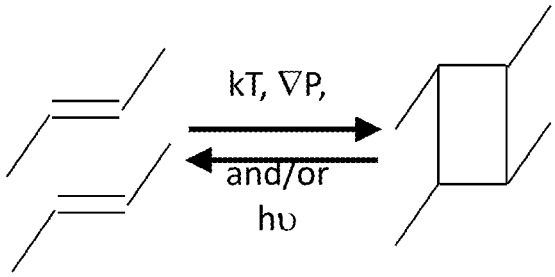
FIG. 2 illustrates a reaction schematic of a typical solid state organic reaction. Usually, the reaction requires trapping of excitons near the reaction center and the reacting centers must be in a crystalline lattice no more than 4 Å apart. However, the large pressure gradients imposed by a blast on a similar system would likely not require photo-excitation (excitonic) or a crystalline lattice.

However, other plastics may be as good as or better than PVC due to their inherent structure and solid state reaction topology at extreme pressure gradients, similar to those found in blasts. For instance, acrylonitrile butadiene styrene (ABS) may be a better energy absorber than PVC. The copolymer contains double bond groups that could react during a high pressure gradient generated by a blast. Similar types of reactions have been studied previously by Eckhardt, et. al., and others in the field of solid-state organic reactions (see references 1-3 below). Basically, the reaction scheme in solid-state organic photoreactions follow a path from two adjacent double bond moieties to a single cyclobutane ring as shown in FIG. 2.

Similarly, blast energy can be absorbed by means of a materials phase transitions including solid-solid, solid-liquid, solid-vapor, and liquid-vapor. For example, paraffin and paraffin polymer composites can be engineered to have a range of melting points tunable to optimize blast energy absorption for a specific application.

Structures for Shock Wave and Blast Product Impedance Matching

As a result of the natural laws of conservation of momentum and energy, the best possible case for energy dissipation and minimum momentum transfer occurs for a maximum inelastic collision of the shock and blast wave. This occurs when there is no reflection of the shock and blast waves, that is, the effective impedance of the armor matches that of the incoming shock and blast wave. The impedance matching layer as described herein improves shock and blast wave coupling into the armor front plate, thereby reducing the intensity of the reflected waves and minimizing kinetic energy and momentum transfer to the armor system. The energy carried by the shock and blast waves can be transformed and stored in a sacrificial layer that can react in the time it takes for the shock wave to travel across individual atomic planes, ~0.1 psec. As previously demonstrated, failure wave energy absorption by a brittle material placed behind the armor front plate can facilitate the stringent requirement.

Previous armor systems have utilized layered structures of alternating density materials to maximize coupling of the shock and blast wave to components comprising the armor system, designed to adsorb energy from the impulse. However, the previous armor systems' front surfaces have been comprised of a hard material which maximizes blast and shock wave reflection. Even an armor system having a softer front surface may produce a significant reflected blast wave due to the softer material's behavior under the extreme compressive strain rates experienced during a blast. Materials that typically display significant compliance under moderate strain rates will display low compliance under the extreme compressive strain rates experienced during a blast. The impedance matching system as described herein possesses a density gradient that minimizes or eliminates a distinguishable material boundary from which a significant reflected wave can be produced. Such a graded impedance matching system has an advantage over impedance matching layered structures because the graded system can impedance match a greater range of blast wavelengths than the layered structures. This is because the layered structures are optimized to only couple a blast wave of a specific wavelength and at a specific angle of incidence.

Analogous layered systems have been developed for optical coatings to either allow or prevent specific wavelengths of light from passing through an optical material. Another method of coupling optical wavelength into or through an optical material utilizes the concept of an optical or refractive index gradient normal to the surface through which the light is intended to pass. Such graded materials and/or surface structures have an advantage over layered optical structures because they allow a larger range of optical wavelengths to pass through the optical system.

A material system and process is proposed to maximize coupling of the shock and blast wave into an armor system's front panel, utilizing the concepts of a graded material density and structure design.

Structures of the Material System

Figure 3:
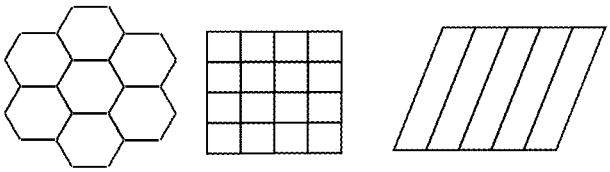
FIG. 3 schematically illustrates various configurations for channel structure. Left—Honey comb structure, Middle—square structure, Right—structure view from a side profile. The structure is tilted with respect to the channel axis, preventing a direct line-of-sight through the structure.

Impedance matching appliqués can be made from structures, for example, channels used commercially as catalytic converter support substrates, and can be used wholly or as part of a blast mitigation system. The channel structure can be mounted such that the channels are directed toward the blast origin or directed at an angle such that the back of the channel openings are obscured by the channel geometry. The channels can have any pattern including square or hexagonal—exemplary structures are shown in FIG. 3. Such channels can trap the blast wave to minimize its reflection.

In another embodiment, the coupling system comprises a binder/filler material and material structure for enabling a density gradient to be created parallel to the impulse propagation direction. The binder may be comprised of paraffin with or without a specific n-alkane distribution, a pure metal or metal alloy, a polymer or copolymer, or polymer blend, or a variety of different configurations comprised of the aforementioned materials.

The material for enabling a density gradient may be comprised of hollow and/or non-hollow nano- and/or microspheres, in which the hollow is fully or partially evacuated, or filled with a solid, liquid, or gas or mixture thereof. Since bimodal particle distributions can produce a greater density, they can create a larger density gradient within a structure. The spheres may be monotonic, bi-distributed, or may have a specific particle size distribution. The spheres can be a mixture of two or more sphere types having different compositions as described above. Two different sphere types could have different densities and sizes and enable a density gradient to be formed.

In one embodiment, the coupling structure may be made from spheres with at least a bi-modal distribution packed and or vibrated to enable the smaller spheres to settle closer to the bottom of the structure and interstitial to the larger microspheres.

Figure 4:
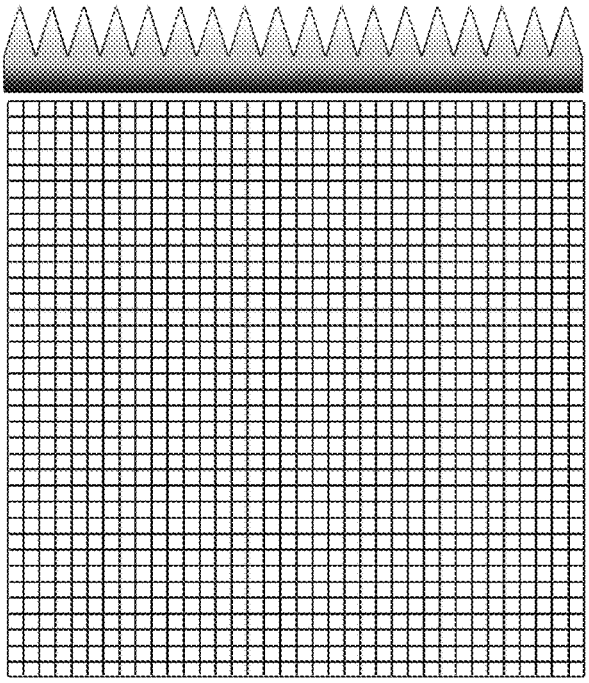
FIG. 4, top, shows a profile or cross-sectional view of density gradient plate. Density increases (dark area) toward the bottom of the plate.

In a further embodiment, shown in FIG. 4, a spire-like array structure served to couple a blast wave from air into a solid material. The coupling material was comprised of ceramic microparticles and glass microspheres in a wax binder in which the particles and microspheres produced a density gradient to reduce blast wave reflection and increase blast wave transmission into the solid material backing the wax gradient appliqué.

Blast tests were also completed using a material without a density gradient but with a spire-like structure, demonstrating the ability of these structures to couple a blast wave into a material. The structure was comprised of a 12"×12"×0.8" type 1 polyvinylchloride sheet having sharp pyramid structures (see FIG. 5). The pyramid face-apex-opposite pyramid face (PAP) angle was 30°. To obtain focusing of the blast wave as it interacts with the structure the spire face-to-face angle must be less than a specific critical angle that prevents reflection of the blast wave and is dependent of the symmetry and structure of the spire-like array.

Figure 6:
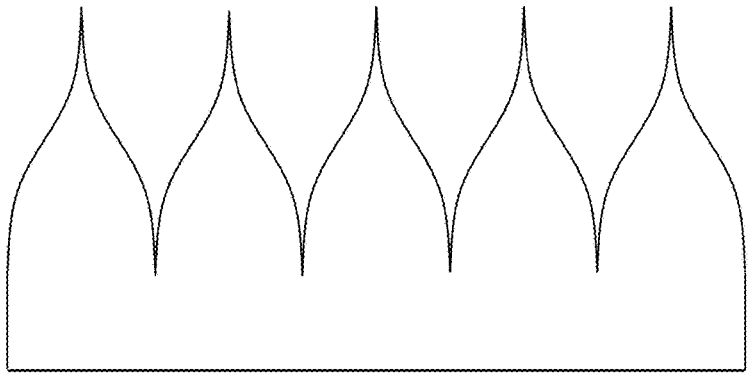
FIG. 6 shows a coupling structure that also minimizes Mach stem formation.
Figure 7:
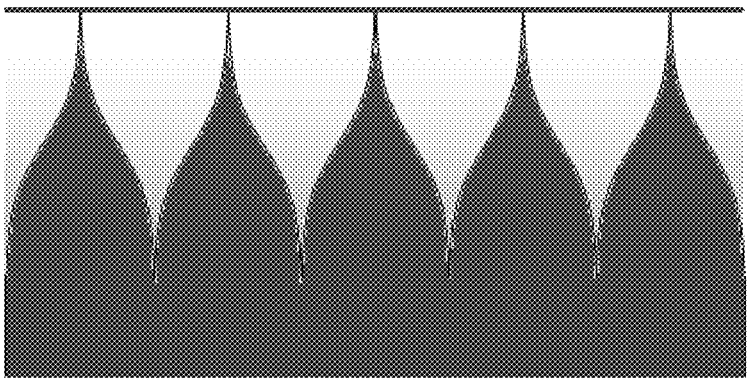
FIG. 7 shows a combined blast wave focusing (red)/density amplifying (same as FIG. 6) and density gradient (gray gradient) structure.

Ideally, the spire-like structure is made having a spire-like geometry resembling a set of tangent function (see FIG. 6). This structure will minimize Mach-stem behavior at the interface and enable better coupling of the blast wave. A combined system is also shown in FIG. 7, which optimizes coupling into the backing material.

Preparing a Density Gradient Structure

In an embodiment, the density gradient structure is made by combining the appropriate materials comprising the structure into a homogenous composition, casting the homogeneous composition into a mold and causing the density gradient to be developed by an appropriate method.

For material cast into a mold, the system can be maintained at a temperature and time adequate for diffusion of particles in the system to create a density gradient. If the temperature and temperature fluctuations in the system are adequate the particles have enough energy to rearrange such that the denser and/or smaller particles settle to the bottom while the larger and/or less dense particles migrate to the top of the casting volume.

This diffusion process can be augmented by additionally vibrating the mold or casting to impart energy into the particles to enhance the particle diffusion process within the cast fluid. Typically, ultrasonic and sonic frequencies should be adequate to achieve faster migration of the particles within the casting.

To obtain a graded structure, the mold can have a structured surface mirroring that of the desired structure of the density graded material. Alternatively, blocks of the density graded material can be ground or machined to have the appropriate structure.

Application of the Density Gradient Structure

The density gradient material made from the aforementioned materials and process is applied to the front surface of armor intended to mitigate the impulse from a blast or projectile. The application can be made through mechanical bonding by direct casting onto the roughened front surface or affixing the system to the front surface using a thin epoxy or adhesive system. To accommodate a diverse set of required applications, the coupling system can be made from smaller components and tiled together on the armor system's front surface.

The aforementioned technique has undergone initial proof of concept at a certified blast test range and has shown promising results, despite use of a gradient material having unoptimized properties.

Figure 9:
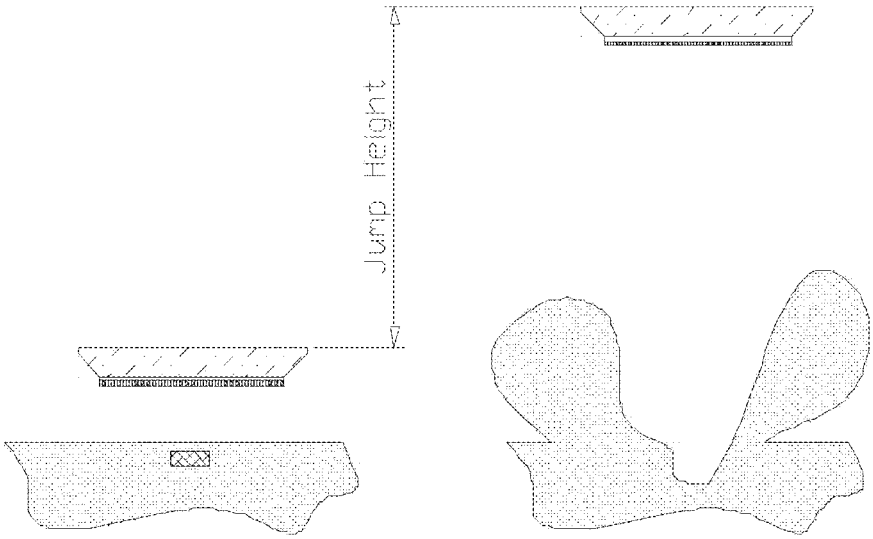
FIG. 9 shows a schematic representation of a test configuration. The armor appliqué is bolted on to the bottom of the armor system.

Jump height provides relevant and reliable data associated with blast testing (see FIG. 9) of the device under test (DUT). The jump height is used to calculate momentum and energy transfer to the DUT by assuming the DUT starts at rest, and is again at rest at the maximum jump height. At this point, all the kinetic energy imparted to the DUT by the threat is converted to potential energy.

Figure 8:
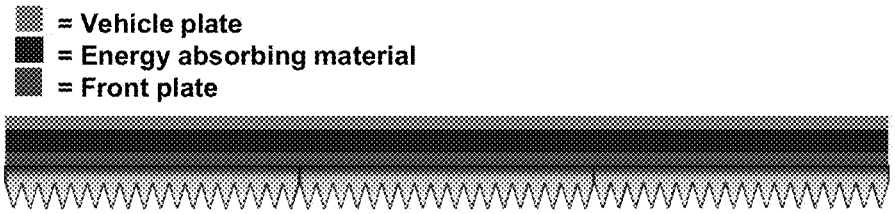
FIG. 8 schematically illustrates an exemplary impulse mitigation system. In this case, the system is designed to protect vehicle and personnel from an impulse from below, such that from an IED.

Table 1 shows a summary of some test results. Concept 3 is a construction similar to that shown in FIG. 8. The blast Impulse and energy reduction are large; 31.1% and 54.3%, respectively. Concepts 1 and 2 are variants of the most successful concept 3 system.

TABLE 1

Blast test results of blast mitigation system described herein

| Total Weight (lbs.) | Configuation | TNT (lbs.) | Jump Height (inches) | Impulse Reduction | Energy Reduction |
|---|---|---|---|---|---|
| 1050 | Reference/ Control | 1.63 | 30.1 | — | — |
| 1089 | Concept 1 | 1.61 | 27.0 | 2.5% | 8.4% |
| 1050 | Concept 2 | 1.62 | 19.4 | 20.3% | 36.5% |
| 1090 | Concept 3 | 1.63 | 13.4 | 31.1% | 54.3% |
| 1050 | Reference/ Control | 1.60 | 31.0 | — | — |

TABLE 2

Jump height from blast tests

| | Jump Height (inches)* | Decrease in Jump Height (%) |
|---|---|---|
| Control | 186.15 | — |
| PVC energy absorber/ impedance matching appliqué | 147.22 | 25.4 |

Blast testing of an embodiment having a cordierite channel structure demonstrated a plate jump height reduction of 30.5% compared to control, from 186.15 inches in the control to 129.31 inches.

Figure 5:
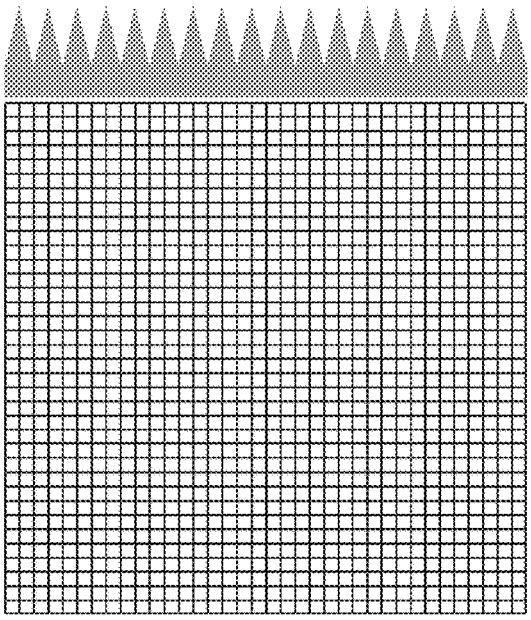
FIG. 5 shows side view (top) and direct view (bottom) of PVC spire-like array.

Blast testing of the PVC structured coupler of FIG. 5 resulted in a 27% decrease in jump height compared to a control, from 216.2 inches to 170 inches.

Further test results are show below in Table 3.

TABLE 3

Results of additional blasts test shots. "On Ground" means the charge was placed on a thick metal plate. "Pot" means the charge is placed in a steel pot, with the top of the charge level with ground. "In Ground" means the charge top is 1 inch below ground in water-saturated soil.

| Shot | Configuration | Location | Charge Size | Energy Reduction (%) | Impulse Reduction (%) |
|---|---|---|---|---|---|
| 5 | Solution 0 | On Ground | 1 X TNT | 0 | 0 |
| 6 | Solution 0 | On Ground | 2 X TNT | 22 | 12 |
| 10 | Solution 1 (Squares) | On Ground | 2 X TNT | 19 | 10 |
| 11 | Solution 1 (Squares) | On Ground | 2 X TNT | 19 | 10 |
| 13 | Solution 1 (Squares) | On Ground | 2 X TNT | 11 | 4 |

TABLE 3-continued

Results of additional blasts test shots. "On Ground" means the charge was placed on a thick metal plate. "Pot" means the charge is placed in a steel pot, with the top of the charge level with ground. "In Ground" means the charge top is 1 inch below ground in water-saturated soil.

| Shot | Configuration | Location | Charge Size | Energy Reduction (%) | Impulse Reduction (%) |
|---|---|---|---|---|---|
| 15 | Solution 1 (no Wax) | On Ground | 2 X TNT | 8 | 3 |
| 16 | Solution (PVC cubes) | On Ground | 2 X TNT | 37 | 20 |
| 17 | Solution 1 | On Ground | 2 X TNT | 54 | 31 |
| 20 | Solution 1 | Pot | 1 X C4 | 39 | 19 |
| 21 | Solution 1 | Pot | 1 X C4 | 30 | 13 |
| 24 | Solution 1 | Pot | 2 X C4 | 26 | 11 |
| 25 | Solution 1 | Pot | 2 X C4 | 17 | 6 |
| 27 | Sol. 1- C only | Pot | 2 X C4 | 4 | 1 |
| 28 | Sol. 1- EA(PVC) | Pot | 2 X C4 | 14 | 5 |
| 29 | Solution 1 | Pot | 2 X C4 | 18 | 6 |
| 30 | Sol. 1- EA only | Pot | 2 X C4 | 1 | −3 |
| 32 | Sol. 2- C(Cordierite) | Pot | 2 X C4 | 24 | 10 |
| 34 | Solution 1 | In Ground | 2 X TNT | 35 | 16 |
| 36 | Solution 1 | In Ground | 2 X TNT | 23 | 9 |
| 38 | Solution 1 | In Ground | 1 X TNT | 22 | 10 |
| 40 | Solution 1 | In Ground | 1 X TNT | 32 | 15 |
| 42 | Sol. 1- no Al | In Ground | 2 X C4 | 27 | 11 |
| 44 | Sol. 1- C(PVC) | In Ground | 2 X C4 | 16 | 5 |
| 45 | Sol. 1- EA(PVC) | In Ground | 2 X TNT | 3 | −2 |

The configuration details for these additional tests were as follows.

Figure 10A:
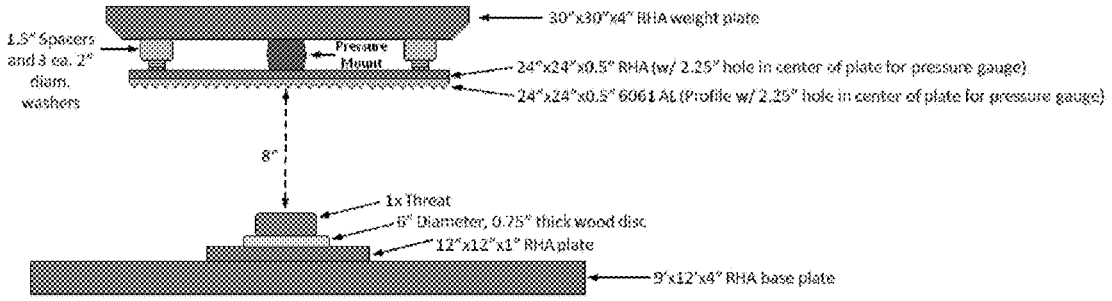
FIGS. 10A-10S illustrate various test configurations used.

Shot 5 (corresponding to FIG. 10A) target configuration (from top to bottom):

30"×30"×4" thick rolled homogeneous armor (RHA) weight
2.125" Al Spacers (w/added washers to increase air gap to fit pressure mount)
24"×24"×0.5" thick RHA plate (w/2.25" hole in center of plate for pressure gauge)
24"×24"×0.5" thick Profile Al plate (w/2.25" hole in center of plate for pressure gauge)
Total Target Weight: 1,050 lb.

Figure 10B:
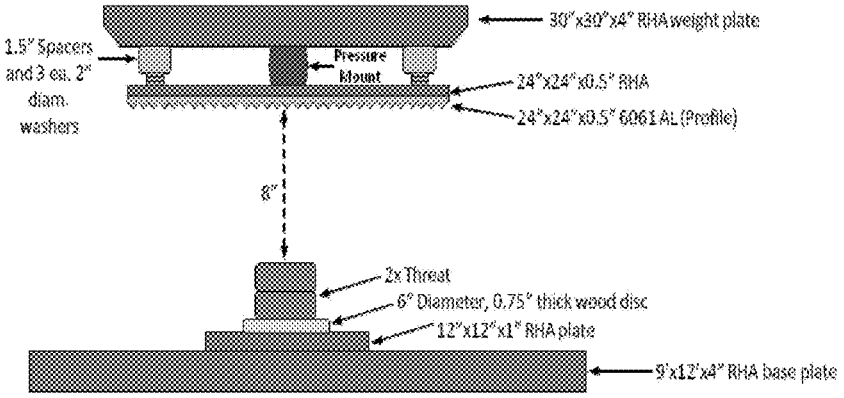
Figure 10C:
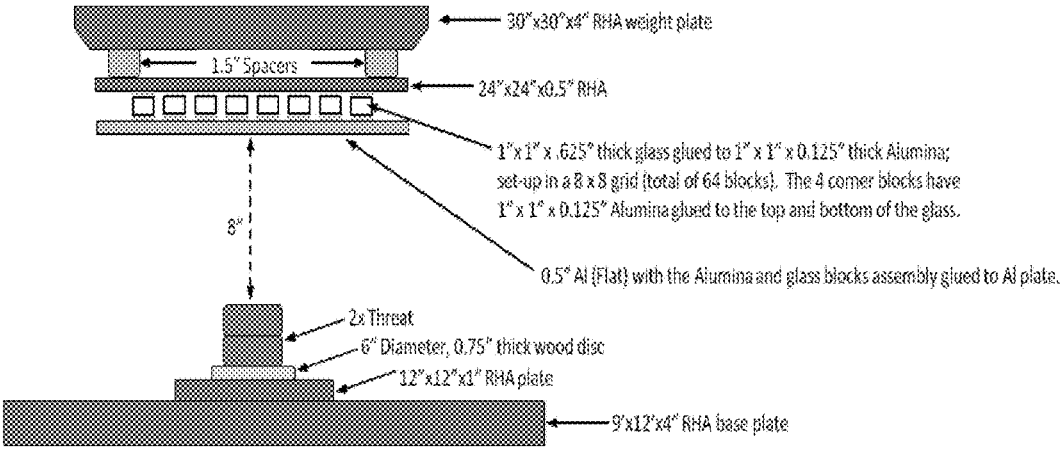

Shot 6 (corresponding to FIG. 10B) target Configuration (from top to bottom):

30"×30"×4" thick RHA Weight
2.125" Al Spacers (w/added washers to increase air gap to fit pressure mount)
24"×24"×0.5" thick RHA plate
24"×24"×0.5" thick Profile Al plate
Total Target Weight: 1,050 lbs Shots 10 and 11 (corresponding to FIG. 10C):

Target Configuration (from top to bottom):
30"×30"×4" thick RHA Weight
1.5" Al Spacers
24"×24"×0.5" thick RHA
4 ea. 1"×1"×0.125" thick Alumina
64 ea. 1"×1"×0.625" thick glass blocks
64 ea. 1"×1"×0.125" thick Alumina
24"×24"×0.5" Al (Flat)
Total Target Weight: 1,055 lbs.

Figure 10D:
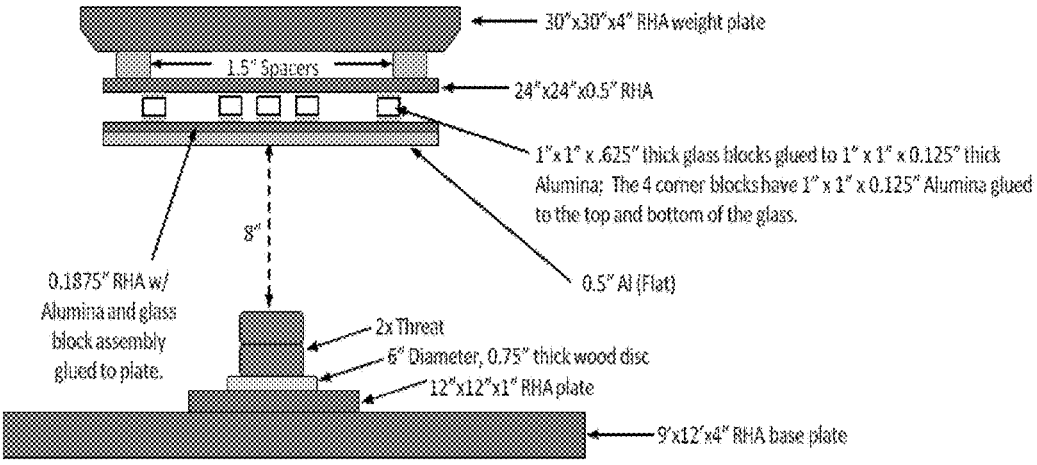

Shot 13 (corresponding to FIG. 10D):

Target Configuration (from top to bottom):
30"×30"×4" thick RHA Weight
1.5" Al Spacers
24"×24"×0.5" RHA
4 ea. 1"×1"×0.125" thick Alumina
9 ea. 1"×1"×0.625" thick glass blocks
9 ea. 1"×1"×0.125" thick Alumina
24"×24"×0.1875" RHA
24"×24"×0.5" Al
Total Target Weight: 1,085 lbs.

Figure 10E:
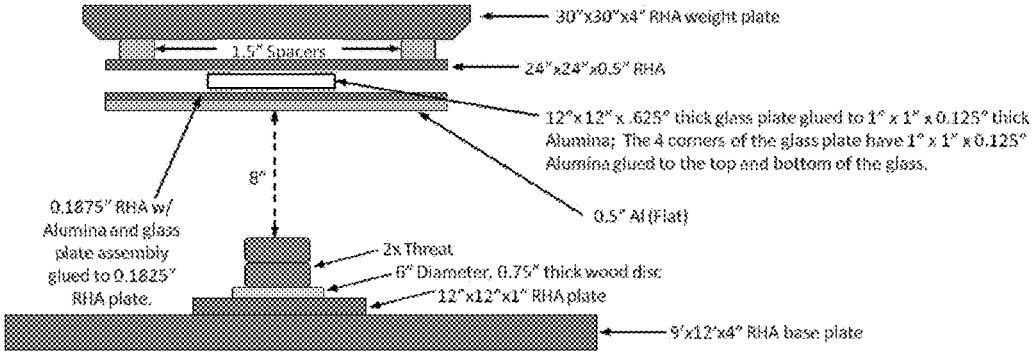

Shot 15 (corresponding to FIG. 10E):

Target Configuration (from top to bottom):
30"×30"×4" thick RHA Weight
1.5" Al Spacers
24"×24"×0.5" RHA
4 ea. 1"×1"×0.125" Alumina
12"×12"×⅝" glass plate
17 ea. 1"×1"×0.125" Alumina
24"×24"×0.1875" RHA
24"×24"×0.5" Al
Total Target Weight: 1,089 lbs.

Figure 10F:
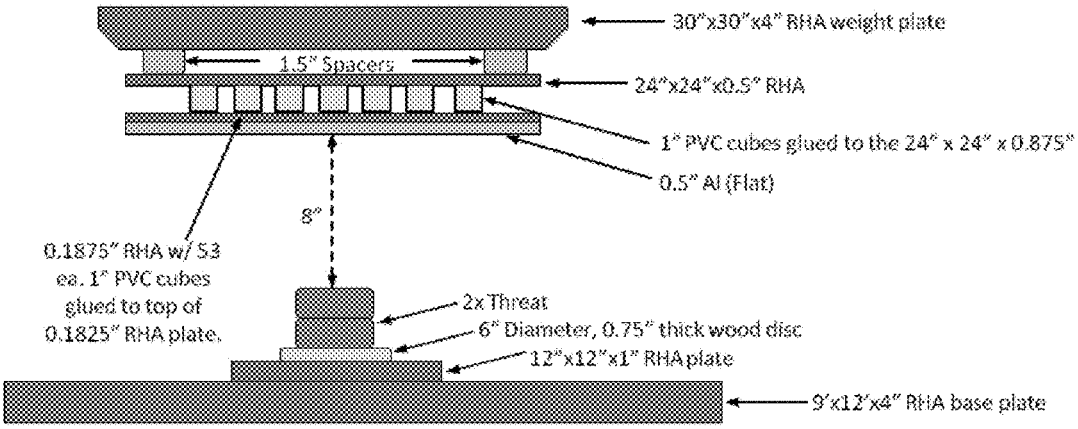

Shot 16 (corresponding to FIG. 10F):

Target Configuration (from top to bottom):
30"×30"×4" thick RHA Weight
1.5" Al Spacers
24"×24"×0.5" RHA
53 ea—1" cube PVC
24"×24"×0.1875" RHA
24"×24"×0.5" Al
Total Target Weight: 1,050 lbs.

Figure 10G:
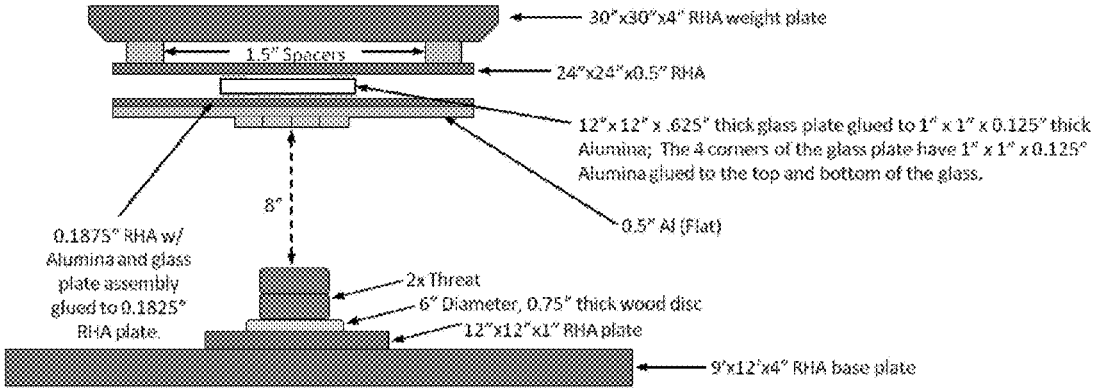

Shot 17 (corresponding to FIG. 10G):

Target Configuration (from top to bottom):
30"×30"×4" thick RHA Weight
1.5" Al Spacers
24"×24"×0.5" RHA
4 ea. 1"×1"×0.125" Alumina
12"×12"×⅝" glass plate
17 ea. 1"×1"×0.125" Alumina
24"×24"×0.1875" RHA
24"×24"×0.5" Al
12 ea. 2"×2"×0.5" Wax w/particles (facing blast)
Total Target Weight: 1,090 lbs.

Figure 10H:
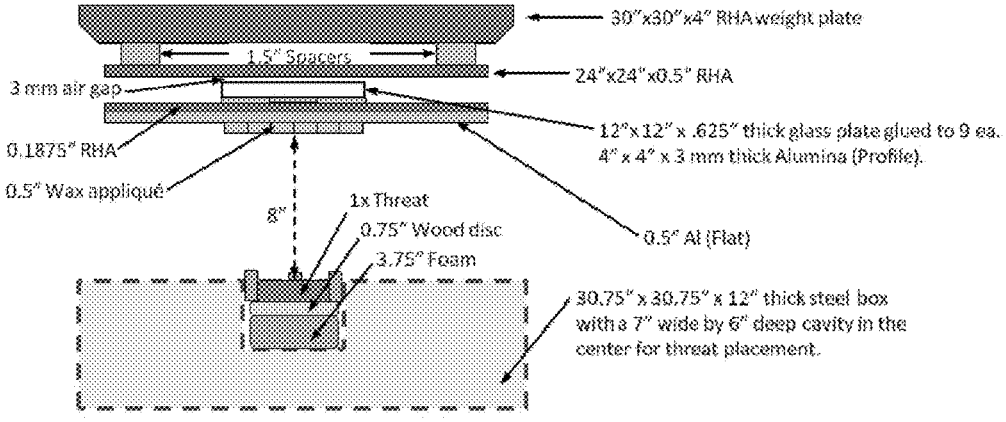

Shots 20 and 21 (corresponding to FIG. 10H):

Target Configuration (from top to bottom):
30"×30"×4" thick RHA Weight
1.5" Al Spacers
24"×24"×0.5" RHA
3 mm air gap
12"×12"×0.625" Glass
3 mm Alumina Amplifier—Profile (9 ea. 4"×4" tiles—3×3 grid)

Figure 10I:
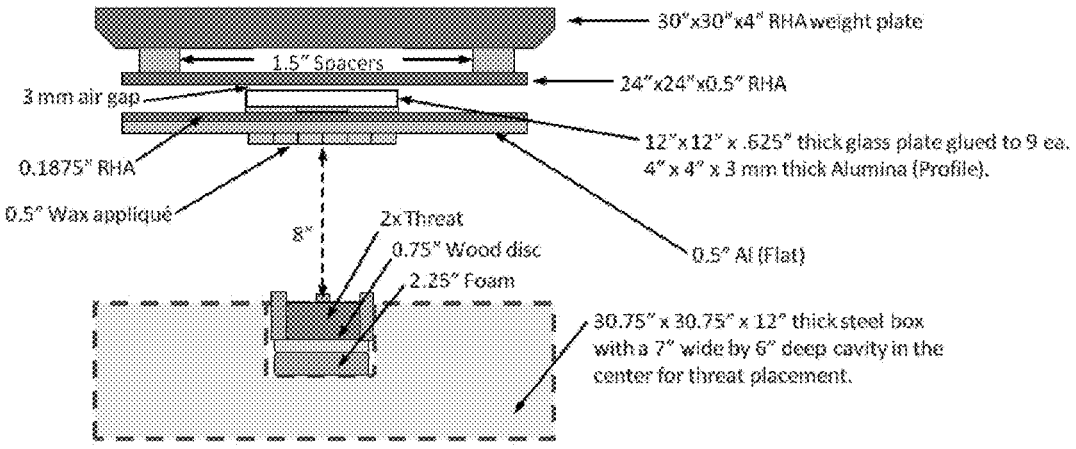
Figure 10J:
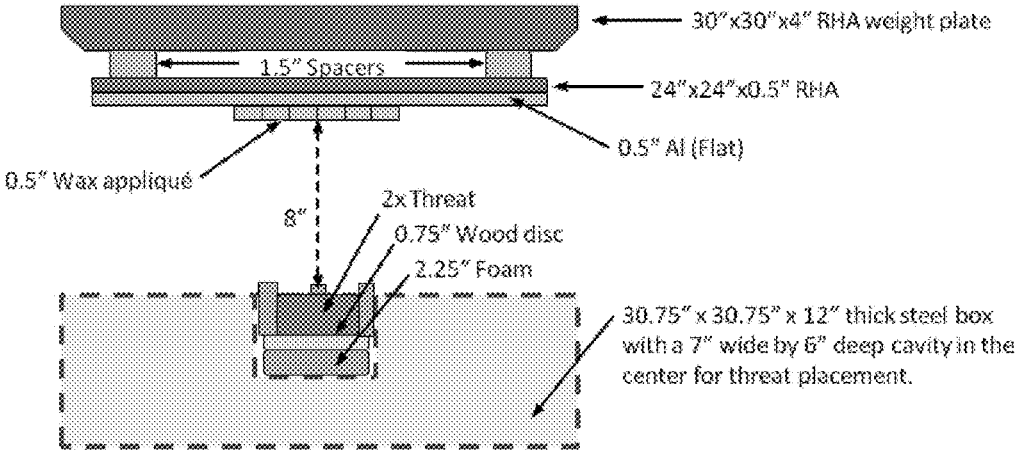
Figure 10K:
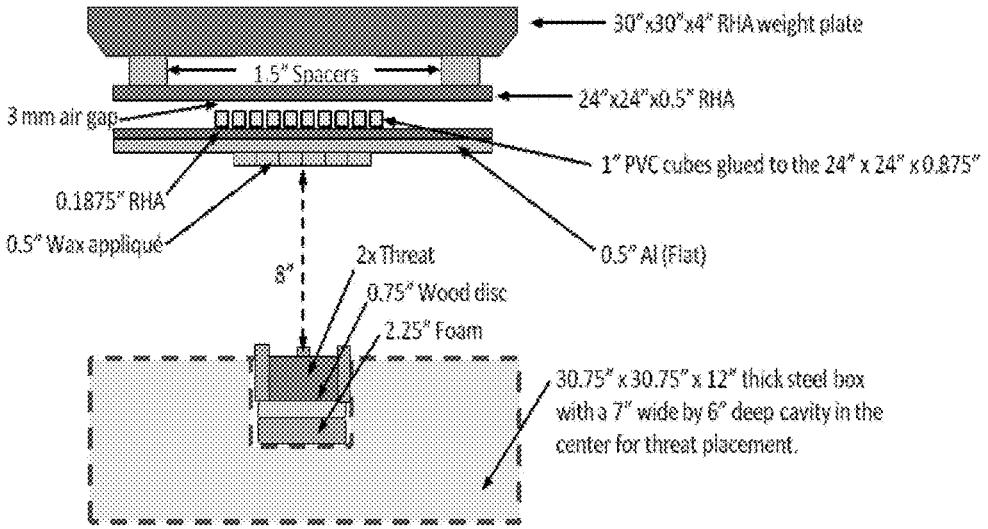
Figure 10L:
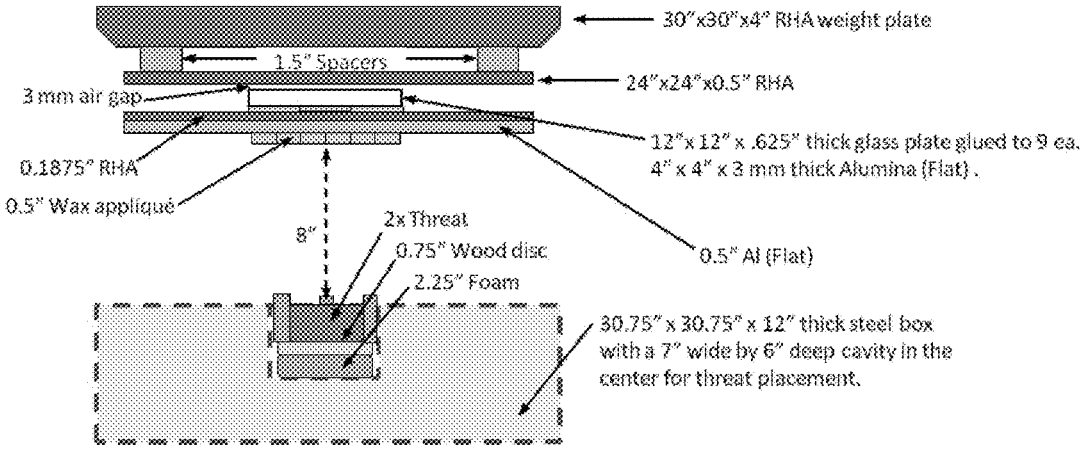
Figure 10M:
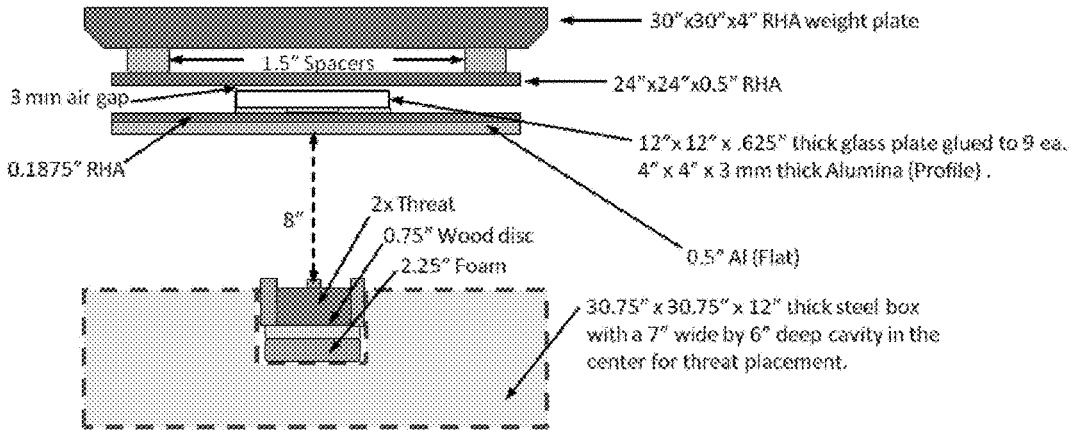
Figure 10N:
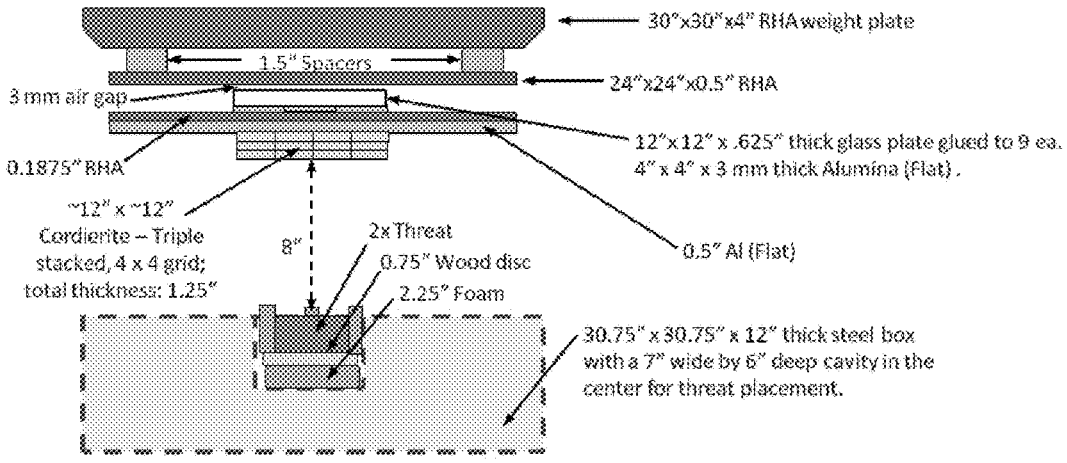
Figure 10O:
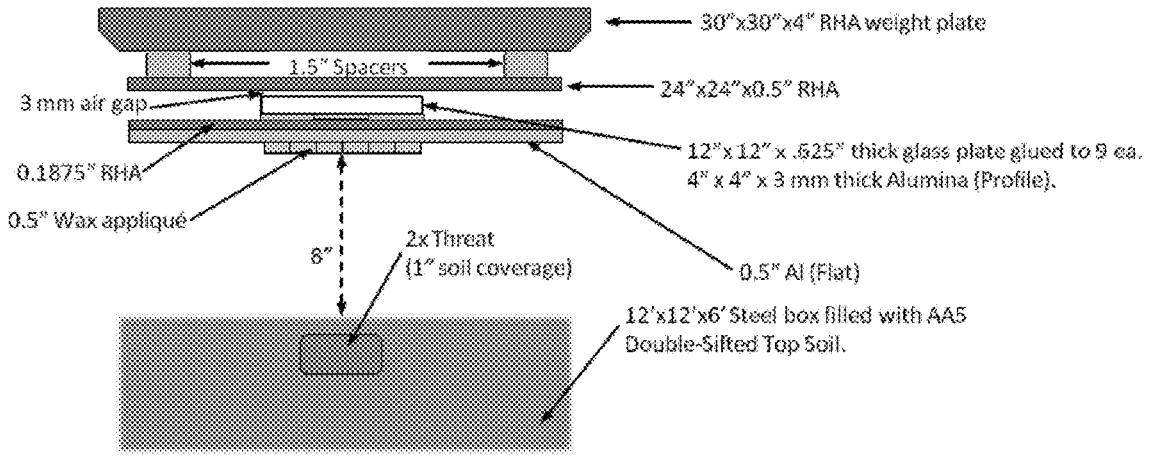
Figure 10P:
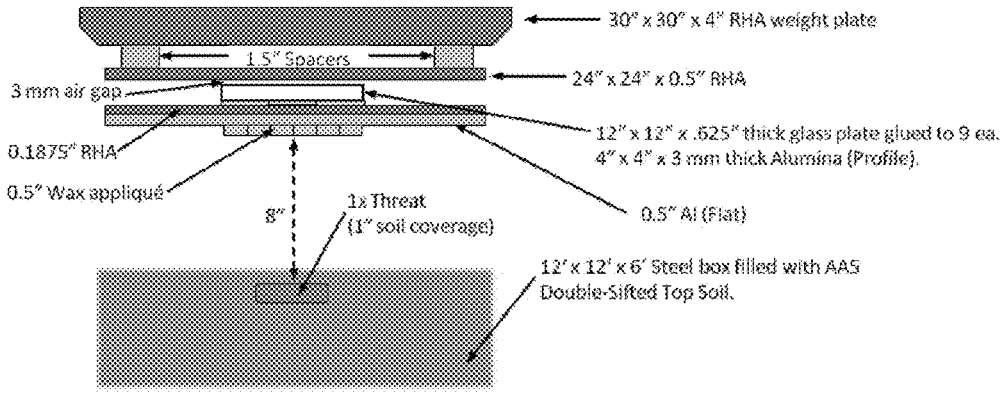
Figure 10Q:
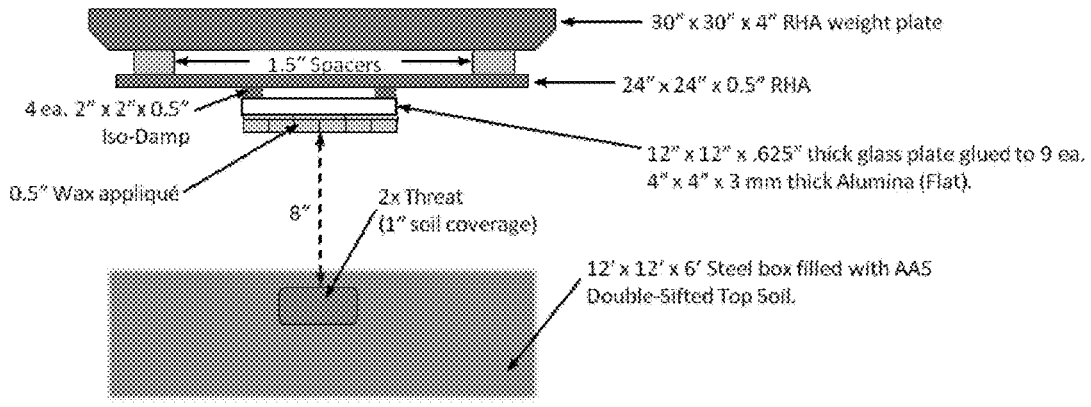
Figure 10R:
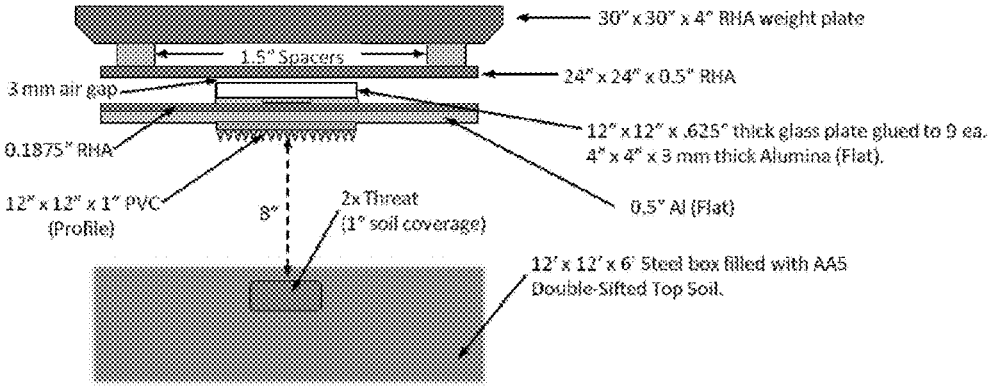
Figure 10S:
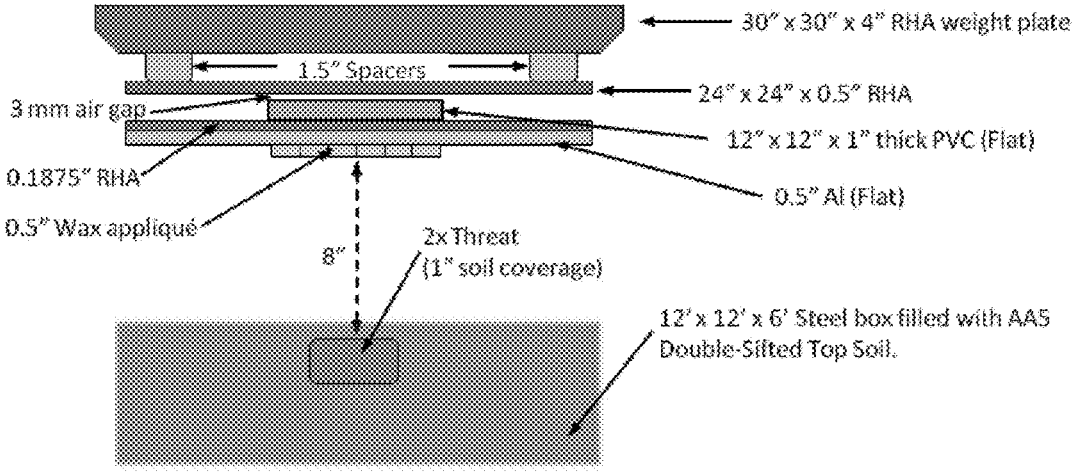

24"×24"×0.1875" RHA
0.5" Al
0.5" Wax appliqué (36 ea. 2"×2" tiles—6×6 grid)
Total Target Weight: 1,086 lbs.
Shots 24 and 25 (corresponding to FIG. 10I):
Target Configuration (from top to bottom):
30"×30"×4" thick RHA Weight
1.5" Al Spacers
24"×24"×0.5" RHA
3 mm air gap
12"×12"×0.625" Glass
3 mm Alumina Amplifier—Profile (9 ea. 4"×4" tiles—3×3 grid)
24"×24"×0.1875" RHA
0.5" Al
0.5" Wax appliqué (36 ea. 2"×2" tiles—6×6 grid)
Total Target Weight: 1,086 lbs.
Shot 27 (corresponding to FIG. 10J):
Target Configuration (from top to bottom):
30"×30"×4" thick RHA Weight
1.5" Al Spacers
24"×24"×0.5" RHA
0.5" Al
0.5" Wax appliqué (36 ea. 2"×2" tiles—6×6 grid)
Total Target Weight: 1,042.4 lbs.
Shot 28 (corresponding to FIG. 10K):
Target Configuration (from top to bottom):
30"×30"×4" thick RHA Weight
1.5" Al Spacers
24"×24"×0.5" RHA
3 mm air gap
100 ea. 1" PVC cubes (10×10 grid—12"×12")
24"×24"×0.1875" RHA
0.5" Al
0.5" Wax appliqué (36 ea. 2"×2" tiles—6×6 grid)
Total Target Weight: 1,078.6 lbs.
Shot 29 (corresponding to FIG. 10L):
Target Configuration (from top to bottom):
30"×30"×4" thick RHA Weight
1.5" Al Spacers
24"×24"×0.5" RHA
3 mm air gap
12"×12"×0.625" Glass
3 mm Alumina Amplifier—Flat (9 ea. 4"×4" tiles—3×3 grid)
24"×24"×0.1875" RHA
0.5" Al
0.5" Wax appliqué (36 ea. 2"×2" tiles—6×6 grid)
Total Target Weight: 1,086 lbs.
Shot 30 (corresponding to FIG. 10M):
Target Configuration (from top to bottom):
30"×30"×4" thick RHA Weight
1.5" Al Spacers
24"×24"×0.5" RHA
3 mm air gap
12"×12"×0.625" Glass
3 mm Alumina Amplifier—Profile (9 ea. 4"×4" tiles—3×3 grid)
24"×24"×0.1875" RHA
0.5" Al
Total Target Weight: 1,083.1 lbs.
Shot 32 (corresponding to FIG. 10N):
Target Configuration (from top to bottom):
30"×30"×4" thick RHA Weight
1.5" Al Spacers
24"×24"×0.5" RHA
3 mm air gap
12"×12"×0.625" Glass
3 mm Alumina Amplifier—Flat (9 ea. 4"×4" tiles—3×3 grid)
24"×24"×0.1875" RHA
0.5" Al
48 ea. 3"×2.5"×9 mm thick Cordierite (4×4 grid—triple stacked)
Total Target Weight: 1,087.1 lbs.
Shots 34 and 36 (corresponding to FIG. 10O):
Target Configuration (from top to bottom):
30"×30"×4" thick RHA Weight
1.5" Al Spacers
24"×24"×0.5" RHA
3 mm air gap
12"×12"×0.625" Glass
3 mm Alumina Amplifier—Profile (9 ea. 4"×4" tiles—3×3 grid)
24"×24"×0.1875" RHA
0.5" Al
0.5" Wax appliqué (36 ea. 2"×2" tiles—6×6 grid)
Total Target Weight: 1,086 lbs.
Shots 38 and 40 (corresponding to FIG. 10P):
Target Configuration (from top to bottom):
30"×30"×4" thick RHA Weight
1.5" Al Spacers
24"×24"×0.5" RHA
3 mm air gap
12"×12"×0.625" Glass
3 mm Alumina Amplifier—Profile (9 ea. 4"×4" tiles—3×3 grid)
24"×24"×0.1875" RHA
0.5" Al
0.5" Wax appliqué (36 ea. 2"×2" tiles—6×6 grid)
Total Target Weight: 1,083.9 lbs.
Shot 42 (corresponding to FIG. 10Q):
Target Configuration (from top to bottom):
30"×30"×4" thick RHA Weight
1.5" Al Spacers
24"×24"×0.5" RHA
4 ea. 2"×2"×0.5" Iso-Damp (positioned in the 4 corners on top of the glass)
12"×12"×0.625" Glass
3 mm Alumina Amplifier—Flat (9 ea. 4"×4" tiles—3×3 grid)
0.5" Wax appliqué (36 ea. 2"×2" tiles—6×6 grid)
Total Target Weight: 1,086 lbs.
Shot 44 (corresponding to FIG. 10R):
Target Configuration (from top to bottom):
30"×30"×4" thick RHA Weight
1.5" Al Spacers
24"×24"×0.5" RHA
3 mm air gap
12"×12"×0.625" Glass
3 mm Alumina Amplifier—Flat (9 ea. 4"×4" tiles—3×3 grid)
24"×24"×0.1875" RHA
0.5" Al
12"×12"×1" PVC (Profile)
Total Target Weight: 1,085.7 lbs.
Shot 45 (corresponding to FIG. 10S):
Target Configuration (from top to bottom):
30"×30"×4" thick RHA Weight
1.5" Al Spacers
24"×24"×0.5" RHA
3 mm air gap
12"×12"×1" PVC (Flat)
24"×24"×0.1875" RHA
0.5" Al
0.5" Wax appliqué (36 ea. 2"×2" tiles—6×6 grid)
Total Target Weight: 1,084.8 lbs.

All documents mentioned herein are hereby incorporated by reference for the purpose of disclosing and describing the particular materials and methodologies for which the document was cited.

Although the present invention has been described in connection with preferred embodiments thereof, it will be appreciated by those skilled in the art that additions, deletions, modifications, and substitutions not specifically described may be made without departing from the spirit and scope of the invention. Terminology used herein should not be construed as being "means-plus-function" language unless the term "means" is expressly used in association therewith.

REFERENCES

Each of the following is incorporated by reference herein in its entirety (1) Acoustic waves excited by phonon decay govern the fracture of brittle materials, Yan Kucherov, Graham Hubler, John Michopoulos, and Brant Johnson *J. Appl. Phys.* 111, 023514 (2012).

(2) Energetics of organic solid-state reactions: the topochemical principle and the mechanism of the oligomerization of the 2,5-distyrylpyrazine molecular crystal, N. M. Peachey and C. J. Eckhardt, *Journal of the American Chemical Society* 1993 115 (9), 3519-3526.

(3) General Theoretical Concepts for Solid State Reactions: Quantitative Formulation of the Reaction Cavity, Steric Compression, and Reaction-Induced Stress Using an Elastic Multipole Representation of Chemical Pressure, Tadeusz Luty and Craig J. Eckhardt, *Journal of the American Chemical Society* 1995 117 (9), 2441-2452.

What is claimed is:

1. An armor system comprising:

an armor plate, and an appliqué affixed to an exterior of the armor plate, wherein the appliqué has a density increasing in a direction towards the armor plate and is configured to minimize reflection of a blast wave from the armor plate, the appliqué comprising sharply-pointed spires extending away from the armor plate interspersed with sharply-pointed troughs extending towards the armor plate, the spires and troughs having a geometry approximating a tangent function with a magnitude of 1.

2. The armor system of claim 1, wherein the armor system further comprises a layer of polymeric energy absorbing material.

3. The armor system of claim 2, wherein said polymeric energy absorbing material is selected from the group consisting of polyvinylchloride and acrylonitrile butadiene styrene.

4. The armor system of claim 1, wherein the appliqué comprises filler particles in a binder configured to contribute to said increasing density.

5. The armor system of claim 4, wherein said filler particles comprise hollow nano- and/or micro-spheres, in which the hollow is fully or partially evacuated.

6. The armor system of claim 4, wherein said filler particles have at least a bimodal size distribution.

7. The armor system of claim 1, wherein said sharply-pointed spires are exposed to air.

8. The armor system of claim 1, further comprising a polymeric material disposed between said spires.

9. The armor system of claim 8, wherein said polymeric material has a density gradient.

10. The armor system of claim 1, wherein the appliqué is affixed to the armor plate via direct casting, epoxy, adhesive, bolts, or a combination thereof.

11. The armor system of claim 1, wherein the density of each spire increases from spire tip to spire base.

* * * * *